United States Patent [19]

Metrailer et al.

[11] 4,057,487

[45] Nov. 8, 1977

[54] FLUID COKING PROCESS

[75] Inventors: William J. Metrailer, Baton Rouge, La.; Joseph P. Matula, Randolph, N.J.

[73] Assignee: Exxon Research & Engineering Co., Linden, N.J.

[21] Appl. No.: 706,218

[22] Filed: July 19, 1976

[51] Int. Cl.[2] ..... C10G 9/32

[52] U.S. Cl. ..... 208/81; 208/101; 208/127

[58] Field of Search ..... 208/127, 101, 102, 81

[56] References Cited

U.S. PATENT DOCUMENTS

| | | | |
|---|---|---|---|
| 3,144,400 | 8/1964 | Weinberg et al. | 208/127 |
| 3,702,516 | 11/1972 | Luckenbach | 208/127 |

*Primary Examiner*—Herbert Levine

*Attorney, Agent, or Firm*—Marthe L. Gibbons

[57] ABSTRACT

A hydrocarbonaceous oil is introduced to a quench and scrubbing zone mounted on a fluid coking reactor. Heat from the coker vapor product vaporizes a portion of the hydrocarbonaceous oil. The unvaporized portion of the oil is used to quench and scrub the coker vapor product. The bottoms fraction of the quench and scrubbing zone is passed to a vacuum distillation zone to recover a heavy oil fraction and to produce a vacuum residuum for use as coker feed.

2 Claims, 1 Drawing Figure

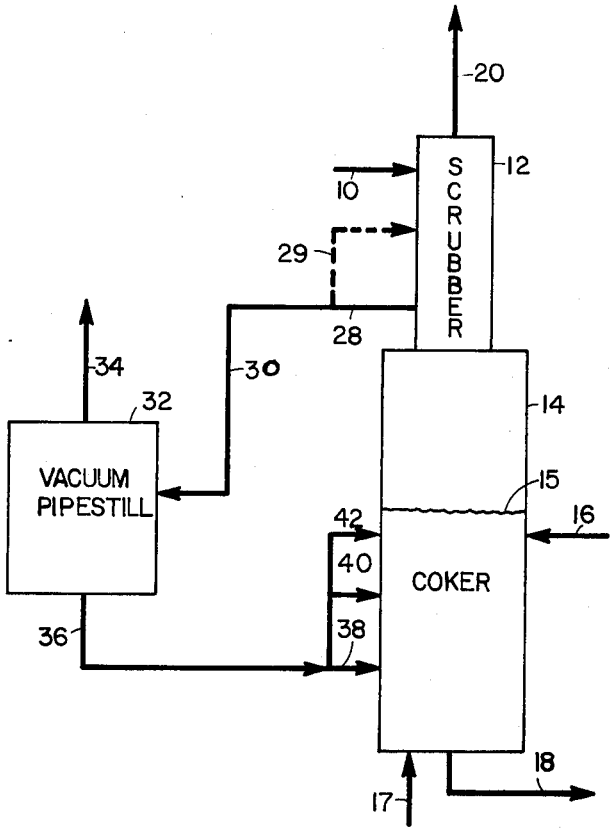
20
12
SCRUBBER
10
29
28
34
30
32
14
VACUUM PIPESTILL
15
16
42
40
COKER
36
38
18
17

FLUID COKING PROCESS

BACKGROUND OF THE INVENTION

1. Field of the Invention

The present invention relates to an improvement in a fluid coking process.

2. Description of the Prior Art

The fluid coking process is a well known process and is disclosed in U.S. Pat. No. 2,881,130, the teachings of which are hereby incorporated by reference. Integrated fluid coking and coke gasification processes are also known and disclosed, for example, in U.S. Pat. Nos. 3,661,543 and 3,816,084, the teachings of which are hereby incorporated by reference.

The present invention is applicable to conventional fluid coking processes as well as to integrated fluid coking and coke gasification processes.

It is known to use hot coking reactor vapors to lift the 700° to 925° F. portion of atmospheric residuum overhead with a coking reactor product and to feed the 925° F.+ bottoms portion directly to the coking reactor as disclosed by Bush, R. A. in Oil and Gas Journal, April 6, 1970, page 110.

U.S. Pat. No. 3,144,400 discloses a fluid coking process in which whole petroleum crude oil is introduced into the scrubbing section with products from the coking vessel. Bottoms from the scrubbing section form the heavy oil feed going to a coking vessel.

It has now been found that a fluid coking process in which a hydrocarbonaceous oil is fed to the scrubber of the coker vapor product and in which the scrubber bottoms fraction is passed to a vacuum distillation zone will result in certain advantages such as reduction in the size of the vacuum pipestill, energy savings, increased liquid yields and other advantages that will become apparent in the ensuing description.

SUMMARY OF THE INVENTION

In accordance with the invention there is provided, in a process wherein a heavy hydrocarbon oil is cracked to a vaporous product including normally liquid hydrocarbons and to coke in a dense fluidized bed of solid particles in a coking zone maintained under coking conditions, which comprises the steps of passing a hot vaporous product from said coking zone to a quench and scrubbing zone, introducing a hydrocarbonaceous oil feed to said scrubbing zone for contacting said oil feed with said vaporous product to condense heavy hydrocarbons from said vaporous product and to vaporize lower boiling hydrocarbons from said oil feed, and withdrawing at least a portion of a bottoms fraction from said scrubbing zone, the improvement which comprises: passing at least a portion of said withdrawn bottoms fraction from said scrubbing zone to a vacuum distillation zone and passing at least a portion of the vacuum distillation zone bottoms fraction to said coking zone.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a hydrocarbonaceous oil, such as for example an atmospheric distillation residuum having an atmospheric boiling point of about 650° F.+ is passed by line 10 into a scrubber 12 mounted on a fluid coking reactor 14. Although for simplicity of description, atmospheric residuum will be used to designate the hydrocarbonaceous oil, other hydrocarbonaceous oil suitable for introduction into the scrubber in accordance with the present invention include whole petroleum crude oil, whole tar sand bitumen, and whole shale oil. In fluid coking reactor 14 is maintained a fluidized dense bed of solids (e.g. coke particles of 40 to 1000 microns) having an upper level indicated at 15. A fluidizing gas, e.g. steam, is admitted at the base of coking reactor 14 through line 17 in an amount sufficient to obtain a superficial fluidizing velocity in the range of 0.5 to 5 feet per second. A stream of coke at from about 100 to 800 Fahrenheit degrees in excess of the actual temperature of the coking zone is admitted to coking reactor 14 in an amount sufficient to maintain the coking temperature in the range of about 850° to about 1,400° F. The pressure in the coking zone is maintained in the range of about 5 to about 150 pounds per square inch gauge (psig), preferably in the range of about 5 to about 45 psig. The lower portion of the coking reactor serves as a stripping zone to remove occluded hydrocarbons from the coke. A stream of relatively cold coke is withdrawn from the stripping zone by line 18 for passage into a coke burner, a coke heater or a coke gasifier wherein the coke is heated and recirculated to the coking reactor. In the coking zone, a heavy hydrocarbonaceous oil introduced into the coking reactor is cracked by contact with the hot fluidized solids to coke which deposits on the solids and to a vaporous product including normally liquid hydrocarbons. The vaporous product flows upwardly from the coking zone into a scrubbing zone which is superimposed on the coker. The heat from the vaporous coke product vaporizes and flashes the light gas oil fraction from the atmospheric residuum. The unvaporized portion of the atmospheric residuum quenches and scrubs the vaporous coker product. The vaporous coker product which includes gaseous and normally liquid hydrocarbon products is removed overhead from the scrubber by line 20 for subsequent conventional fractionation and gas recovery. The bottoms fraction of the scrubber comprises the unvaporized portion of the atmospheric residuum and the condensed portion of the vaporous coker product. A portion of the bottoms fraction of the scrubber is withdrawn from the scrubber by line 28 and at least a portion of the withdrawn bottoms fraction is passed by line 30 into a vacuum distillation zone 32 where the scrubber bottoms fraction is subjected to vacuum distillation in a conventional way. A portion of the scrubber bottoms of line 28 may, if desired, be recycled to scrubber 12 by line 29. A heavy gas oil produced by the vacuum distillation is removed from the vacuum distillation zone by line 34. The vacuum distillation bottoms fraction is removed from the vacuum distillation zone by line 36 and introduced into the fluid coker by lines 38, 40 and 42 as coke feed.

An example of a typical coker-vacuum pipestill operation (process A) is compared with the process of the present invention (process B) in the following table. The feed is 58850 barrels per day of Bachaquero atmospheric residuum boiling at 650° F.+

TABLE

| Processing Scheme | A<br>Conventional Vacuum Distillation with Vacuum Residuum to Coker | | B<br>Atmospheric Residuum to Coker Scrubber, Scrubber Bottoms to Vacuum Distillation and Vacuum Bottoms to Coker | |
|---|---|---|---|---|
| Virgin Products | | | | |
| 650 - 900° FVT | — | | 20,460 B/D | |
| 650 - 1050° F FVT | 31,350 B/D | | — | |
| 900 - 1050° FVT | — | | 10,890 B/D | |
| 1050° F+ (To Coker) | 27,500 B/D | | 27,500 B/D | |
| Coker Reactor Products | | | | |
| $H_2S$ | 1.0 wt. % | — | 0.9 wt. % | |
| $C_4$ — Gas | 12.8 wt. % | — | 11.3 wt. % | |
| $C_5$ - 380° FVT | 12.1 wt. % | 4758 B/D | 10.8 wt. % | 2970 B/D |
| 380 - 950° FVT | 39.0 wt. % | 11,715 B/D | — | — |
| 380 - 900° FVT | — | — | 46.0 wt. % | 9020 B/D |
| 900 - 1050° FVT | — | — | 31.0 wt. % | 4648 B/D |
| Coke | 35.1 wt. % | | | |
| Total Combined Gas Oil | 43,065 B/D | | 45,018 B/D | |

In this example, according to process B, the feed to the vacuum pipestill is reduced by 20 vol. % and the amount of gas oil which must be distilled overhead is reduced 50 vol %. This is accomplished by using approximately 80 million BTU/hr. of heat in the coker reactor overhead products to vaporize gas oil instead of using it to generate steam. The feed to the vacuum distillation will contain only about one-fourth the concentration of solids as would be contained in a stream handling the coker product bottoms alone. There is a 4.5 vol. % increase in total gas oil yield with only a minor debit in gas oil quality. Also there is a 11.7 wt. % reduction in coke make. Coker bottoms recycle is reduced about 50 vol. % thereby reducing process heat requirements.

Thus, the process of the present invention affords a number of advantages such as increased utilization of energy since the high level heat from the fluid coker reactor products is used to flash gas oil; lower investment and operating costs for the vacuum pipestill since flashing part of the virgin gas oil in the coker scrubber reduces the quantity of feed to the vacuum pipestill and also the amount of gas oil which must be flashed over to the pipestill.

What is claimed is:

1. In a process wherein a heavy hydrocarbon oil is cracked to a vaporous product including normally liquid hydrocarbons and to coke in a dense fluidized bed of solid particles in a coking zone maintained under fluid coking conditions which comprises the steps of passing a hot vaporous product from said coking zone to a scrubbing zone, introducing a hydrocarbonaceous oil feed to said scrubbing zone for contacting said oil feed with said vaporous product to condense heavy hydrocarbons from said vaporous product and to vaporize lower boiling hydrocarbons from said oil feed, and withdrawing at least a portion of a bottoms fraction from said scrubbing zone, the improvement which comprises: passing at least a portion of said withdrawn bottoms fraction from said scrubbing zone to a vacuum distillation zone and passing a portion of the vacuum distillation zone bottoms fraction to said coking zone, said hydrocarbonaceous oil feed introduced into said scrubbing zone being an atmospheric distillation residuum.

2. The process of claim 1 wherein said coking conditions include a temperature ranging from about 850° F. to about 1,400° F. and a pressure ranging from about 5 to about 150 psig.

* * * * *